US005728029A

United States Patent [19]

Minoura

[11] Patent Number: 5,728,029

[45] Date of Patent: Mar. 17, 1998

[54] BICYCLE EXERCISE DEVICE

[75] Inventor: Kohji Minoura, Gifu-ken, Japan

[73] Assignee: Minoura Co., Ltd., Gifu-ken, Japan

[21] Appl. No.: 770,083

[22] Filed: Dec. 19, 1996

[30] Foreign Application Priority Data

Jul. 10, 1996 [JP] Japan ..... 8-180667

[51] Int. Cl.[6] ..... A63B 23/04

[52] U.S. Cl. ..... 482/61

[58] Field of Search ..... 482/57, 61, 63–65, 482/60

[56] References Cited

U.S. PATENT DOCUMENTS

| | | | |
|---|---|---|---|
| 562,520 | 6/1896 | Fonda | 482/61 |
| 2,972,478 | 2/1961 | Raines | 482/61 |
| 4,572,502 | 2/1986 | Messineo | 482/61 |
| 4,826,150 | 5/1989 | Minoure | 482/61 |

FOREIGN PATENT DOCUMENTS

| | | | |
|---|---|---|---|
| 0060818 | 9/1982 | European Pat. Off. | 482/61 |
| 0104349 | 12/1898 | Germany | 482/61 |
| 06190078 A | 7/1994 | Japan . | |
| 06285182 A | 10/1994 | Japan . | |
| 06304266 A | 11/1994 | Japan . | |

*Primary Examiner*—Stephen R. Crow
*Attorney, Agent, or Firm*—Trask Britt & Rossa

[57] ABSTRACT

A bicycle exercise device that reduces generation of noises during pedaling. Fitting plates are provided to oppose each other at lower positions on a pair of first legs constituting a framework. An arm is fixed to a load resistance generator of a resistance applying unit. A fixing member pivotally supporting the arm thereon is secured to the fitting plate. A rotary drive wheel provided on the arm has a pulley and a transmission wheel, which rotate integrally. The transmission wheel is pressed against a side face of a rim of a bicycle by the urging force of a compression spring located between the fixing member and the arm. The load resistance generated by the load resistance generator is transmitted via a belt, the pulley and the transmission wheel to the rear wheel of the bicycle.

14 Claims, 12 Drawing Sheets

BICYCLE EXERCISE DEVICE

BACKGROUND OF THE INVENTION

1. Field of the Invention

This invention relates to a bicycle exercise device. More particularly, this invention relates to a bicycle exercise device that rotatably supports a drive wheel of bicycle and applies load resistance to the drive wheel so that a rider may perform loaded pedaling exercise.

2. Description of the Related Art

Existing exercise devices support a rear wheel of a bicycle and apply load resistance to the rear wheel to enable a rider to perform loaded pedaling exercise. FIG. 12 shows a prior art exercise device 200. As shown in FIG. 12, a pair of pipes 201,202 are extended parallel to each other to constitute a framework, with two pairs of legs 203 and 204 (only the legs 203,204 located on the front side are shown) extending diagonally upward from each end of the pipes 201,202, respectively. Each leg 204 is connected at its upper end to the upper portion of the corresponding leg 203. The legs 203 are provided respectively at the upper end portions thereof with a pair of holders 205 (only one holder is shown). The holders 205 hold a hub of a rear wheel 211.

A resistance applying unit 206, which applies load resistance to the rear wheel 211, is fixed to the pipe 201. As shown in FIG. 13, the resistance applying unit 206 consists of a resistance generator 207 having a rotary shaft 208 and a drive cylinder 209 secured around the rotary shaft 208.

When the exercise device 200 is to be used, the rear wheel 211 of a bicycle 210 is first mounted on the drive cylinder 209 to bring the outer circumference of a tire 212 of the rear wheel 211 into contact with the outer circumference of the drive cylinder 209. Then, a hub of the rear wheel 211 is held between the holders 205. When pedals 213 of the bicycle 210 are worked, the rear wheel 211 is rotated. Thus, the drive cylinder 209 in contact with this rear wheel 211 is driven.

In this instance, load resistance generated by the resistance generator 207 is transmitted via the drive cylinder 209 to the rear wheel 211. Accordingly, the rider is forced to work the pedals against this load resistance, so that the rider performs suitably loaded pedaling exercise.

Usually, the tire 212 has a tread pattern 212*a* formed on the outer circumference thereof, as shown in FIG. 13, so as to effectively transmit driving force or braking force of the rear wheel 211 during running of the bicycle 210. Accordingly, a problem arises that the corners of the tread pattern 212*a* are periodically bumped against the outer circumference of the drive cylinder 209 with the rotation of the rear wheel 211 thus producing noise. In a tire of a cross-country bicycle, the tread pattern is of block type. Accordingly, loud noise is generated when the exercise device 200 is used with a bicycle having such tires.

SUMMARY OF THE INVENTION

This invention is accomplished in view of the circumstances described above, and it is an objective of the invention to provide a bicycle exercise device that operates quietly.

In order to attain this and other objectives, a first aspect of this invention relates to a bicycle exercise device provided with a framework for rotatably supporting a wheel of a bicycle and a resistance applying unit having a rotary drive member that rotates with the rotation of the wheel and applies load resistance via the rotary drive member to the wheel. The rotary drive member is brought into contact with a side face of a rim of the wheel.

The rotary drive member is rotated with the rotation of the wheel supported by the framework. In this instance, a load resistance is applied to the wheel from a resistance applying unit via the rotary drive member. The rotary drive member is brought into contact with the wheel at the side face of its rim. Accordingly, even if the tire of the wheel has a tread pattern formed thereon, bumping of the tread pattern against the rotary drive member is avoided.

The rotary drive member is designed to be movable toward and away from the side face of the rim, and the device is further provided with an urging mechanism for pressing the rotary drive member against the side face of the rim.

Since the rotary drive member is pressed against the side face of the rim by the urging force of the urging mechanism, load resistance is steadily transmitted from the rotary drive member to the wheel. Further, if an excessive force is applied to the rotary drive member due to lateral movement of the drive wheel (due to an out of balance wheel, for example), the rotary drive member is moved against the urging force of the urging mechanism.

The device is further provided with a position adjusting mechanism for adjusting the position of the rotary drive member in the radial direction of the drive wheel.

The rotary drive member can be brought into contact with side faces of rims having various diameters by adjusting the position of the drive wheel in the radial direction.

The device is further provided with a wheel supporting mechanism, which supports a rotary shaft of the wheel and which allows the wheel to be adjustably moved along the axis of the rotary shaft to move the wheel closer to or further away from the rotary drive member.

BRIEF DESCRIPTION OF THE DRAWINGS

The features of the present invention believed to be novel are set forth with particularity in the appended claims. The invention, together with the objects and advantages thereof, may best be understood by reference to the following description of the presently preferred embodiment together with the accompanying drawings in which:

DETAILED DESCRIPTION OF THE PREFERRED EMBODIMENT

A preferred embodiment of this invention will be described referring to FIGS. 1 to 11.

Figure 1:
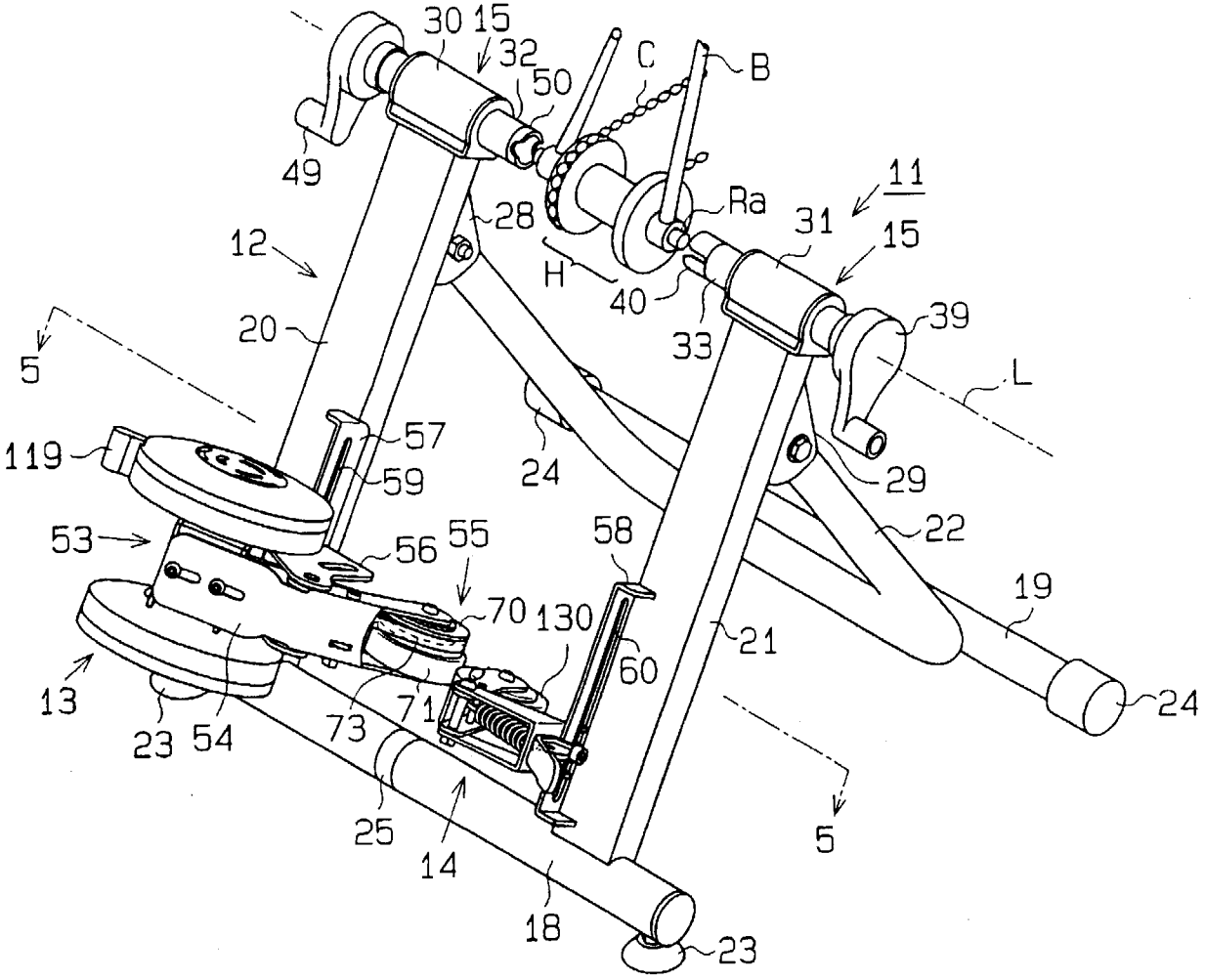
FIG. 1 is a perspective view showing the bicycle exercise device according to this invention.
Figure 2:
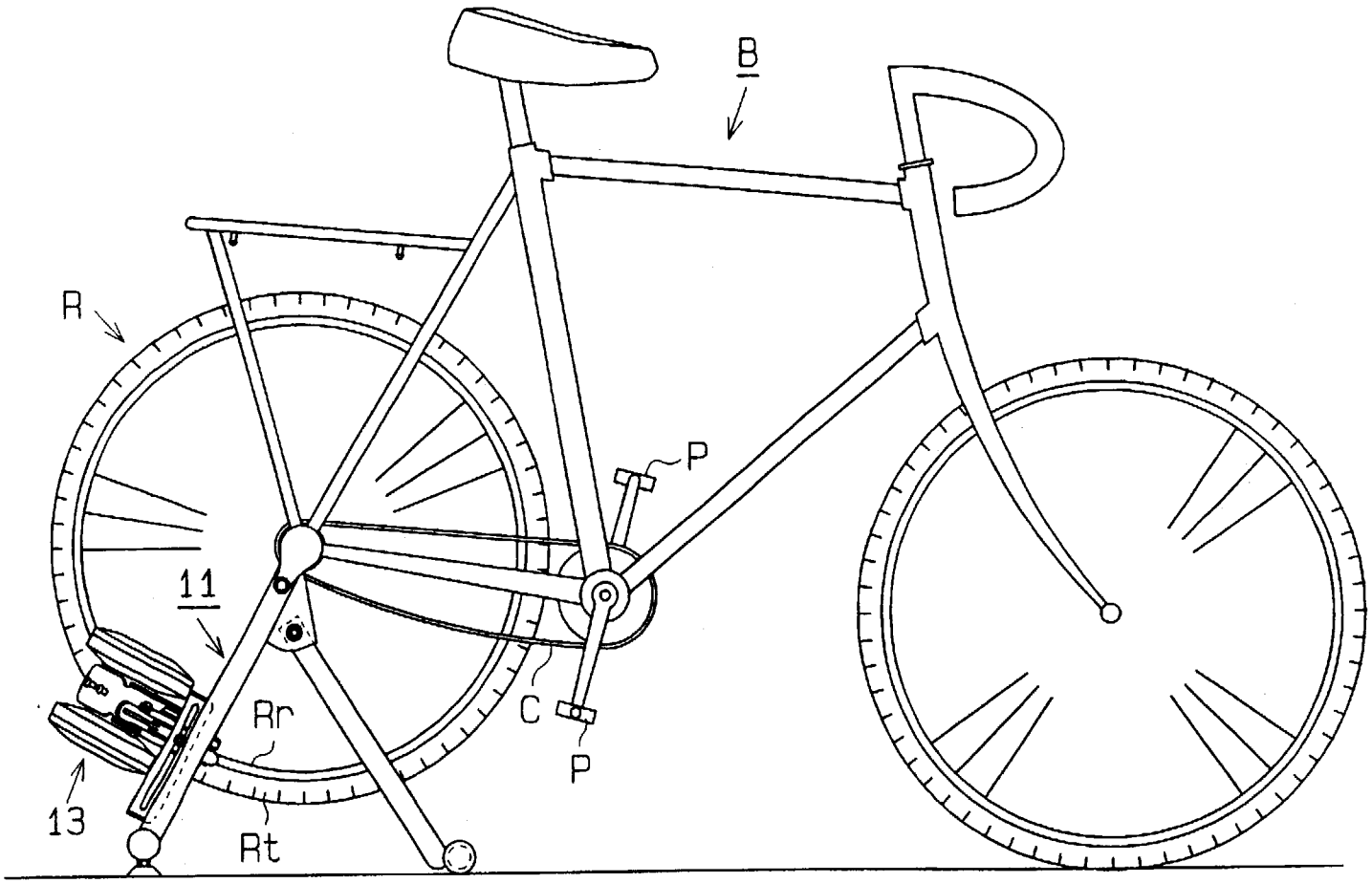
FIG. 2 is a front side of the exercise device showing a state where the device is in use.

FIG. 1 shows a bicycle exercise device 11 according to a preferred embodiment of this invention, and FIG. 2 shows the exercise device 11 in use. As shown in FIG. 1, the exercise device 11 has a framework 12 to be set on the floor, with a resistance applying unit 13, an auxiliary supporting unit 14 and a hub holding mechanism 15 attached to the framework 12.

The framework 12 contains a pair of supporting bars (a rear bar and a front bar) 18,19 extending horizontally and parallel to each other, a pair of rear legs 20,21, each having a rectangular cross section, fixed to the rear support bar 18 and a U-shaped front leg 22 fixed to the front support bar 19. A foot 23 is attached to each end of the bottom of the rear bar 18, and another foot 24 is fitted to each end of the front support bar 19. Each foot 23 attached to the rear support bar 18 is adjustable by a screw (not shown) to vary the distance between the floor and the rear support bar 18. Accordingly, the support bars 18,19 are retained above the floor. The height of each foot 23 is adjusted so that the support bar 18 is level and to provide stable support for the exercise device 11 on the floor and to protect the support bars 18,19.

A positioning tape 25 is applied to the rear support bar 18 at the center. This tape 25 is used for positioning a rear wheel R (drive wheel) between the first legs 20 and 21 after a shaft Ra of a hub H of a bicycle B is held by the hub holding mechanism 15, which will be described later.

As shown in FIG. 1, the rear legs 20,21 and the front leg 22 are slanted such that the distance between the rear legs 20,21 and the front leg 22 decreases in the upward direction. The upper end portions of the front leg 22 are pivotally connected to connecting portions 28,29 provided on the rear legs 20,21, respectively. Accordingly, the exercise device 11 can be folded by turning the front leg 22 about the connecting portions 28,29 to pull the front support bar 19 closer to the rear support bar 18 and can be stored in the folded state.

The hub holding mechanism 15 attached to the framework 12 rotatably holds the rear wheel R of the bicycle B and adjusts the position of the rear wheel R. The hub holding mechanism 15 contains a pair of holding cylinders 30,31 attached to the upper ends of the rear legs 20,21, respectively, and a pair of operating cylinders 32,33 supported in the holding cylinders 30,31, respectively, to be axially movable.

Figure 3:
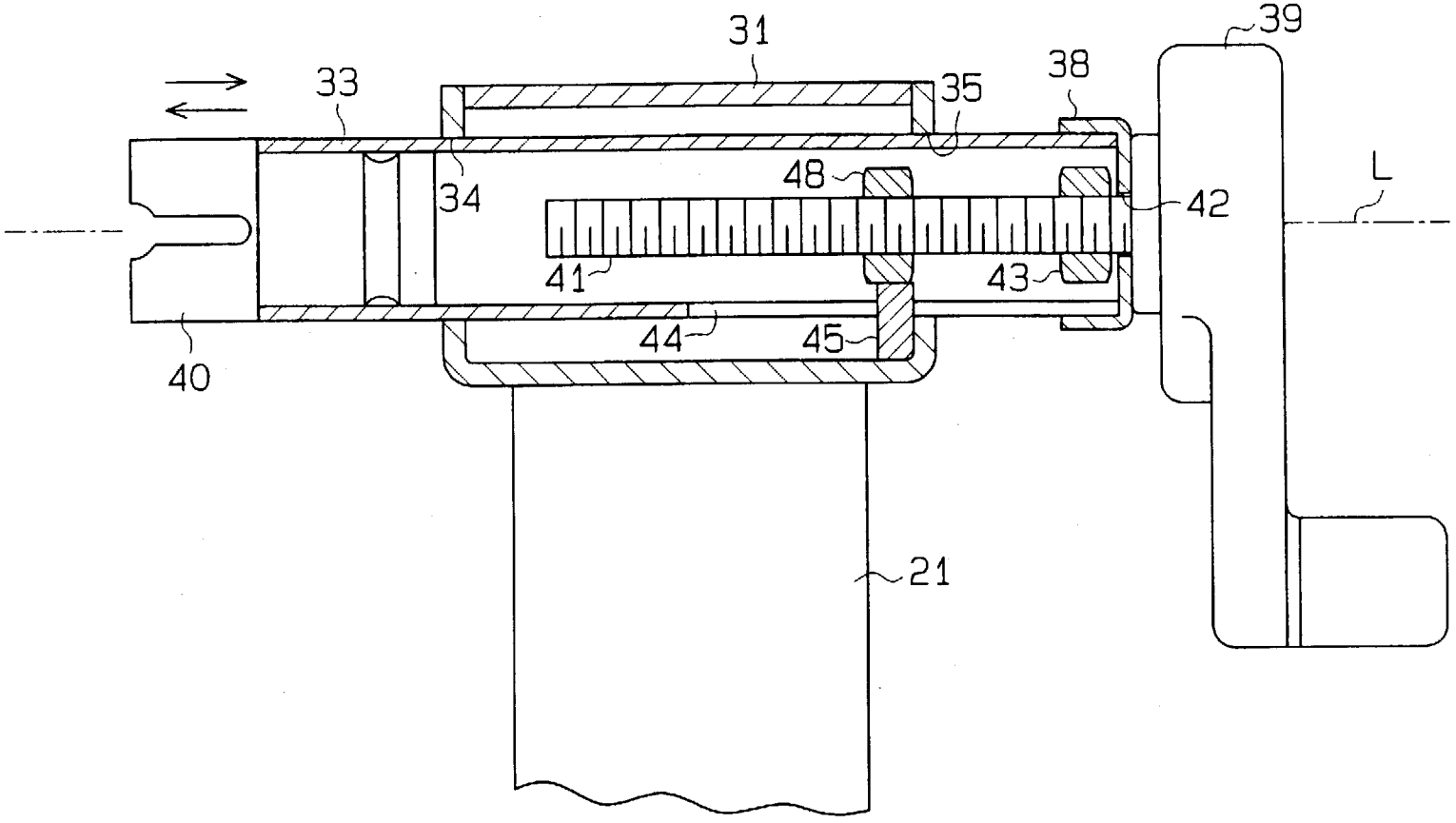
FIG. 3 is a cross-sectional view showing a part of a hub holder.

FIG. 3 shows the holding cylinder 31 located on one of the first legs 21. The holding cylinder 31 has insertion holes 34,35 at each end. The operating cylinder 33 is inserted through the insertion holes 34,35 such that each end of the cylinder 33 protrudes outward through these holes 34,35. The other holding cylinder 30 is the same and the operating cylinder 32 is likewise inserted through insertion holes (not shown). The operating cylinders 32,33 are aligned on the same axial line L, as shown in FIG. 1.

As shown in FIG. 3, a cap 38 is fixed to one end (the right end in FIG. 3) of the operating cylinder 33. An operating handle 39 contacts the cap 38 and is rotatable relative to the holding cylinder 31. Meanwhile, a cylindrical holder 40 for holding the hub H is fitted to the other end (the left end in FIG. 3) of the operating cylinder 33. A bolt 41 fixed to the operating handle 39 is inserted into the cylinder 33 with play through a center hole 42 defined in the cap 38. A nut 43 is fixed to the bolt 41 within the operating cylinder 33. The operating handle 39 is restricted by this nut 43 from moving in the axial direction L, so that the handle 39 does not move axially relative to the operating cylinder 33 (ignoring play).

A slit 44 is defined at the bottom of the operating cylinder 33 to extend in the axial direction. A supporting piece 45 is fixed to the holding cylinder 31 on the inner bottom surface, with the upper end portion of the piece 45 extending through the slit 44 into the operating cylinder 33. A nut 48 is fixed to the upper end of this supporting piece 45, and the bolt 41 of the operating handle 39 is screwed into this nut 48. Accordingly, the bolt 41 is advanced or retracted relative to the nut 48, by rotating the operating handle 39 on the bolt 41, to move the operating cylinder 33 in the axial direction L, as indicated by the arrows in FIG. 3.

The holding cylinder 30 and the operating cylinder 32 located on the other rear leg 20 are the same as described above, and the operating cylinder 32 and the holder 50 fitted in the cylinder 32 can be moved in the axial direction L by rotating the operating handle 49 shown in FIG. 1. In the exercise device 11, the positions of the operating cylinders 32,33 can be changed in the axial direction L by rotating the operating handles 39,49 as described above, and thus the distance between the holders 40 and 50 can be adjusted.

Next, the resistance applying unit 13 and the auxiliary supporting unit 14 will be described.

As shown in FIG. 1, the resistance applying unit 13 includes a load resistance generator 53 for generating load resistance to be applied to the rear wheel R of the bicycle B, an arm 54 fixed to the generator 53, a rotary drive wheel 55 serving as a rotary drive member provided on the arm 54 and a fixing member 56 for fixing the arm 54 to the framework 12.

Figure 4:
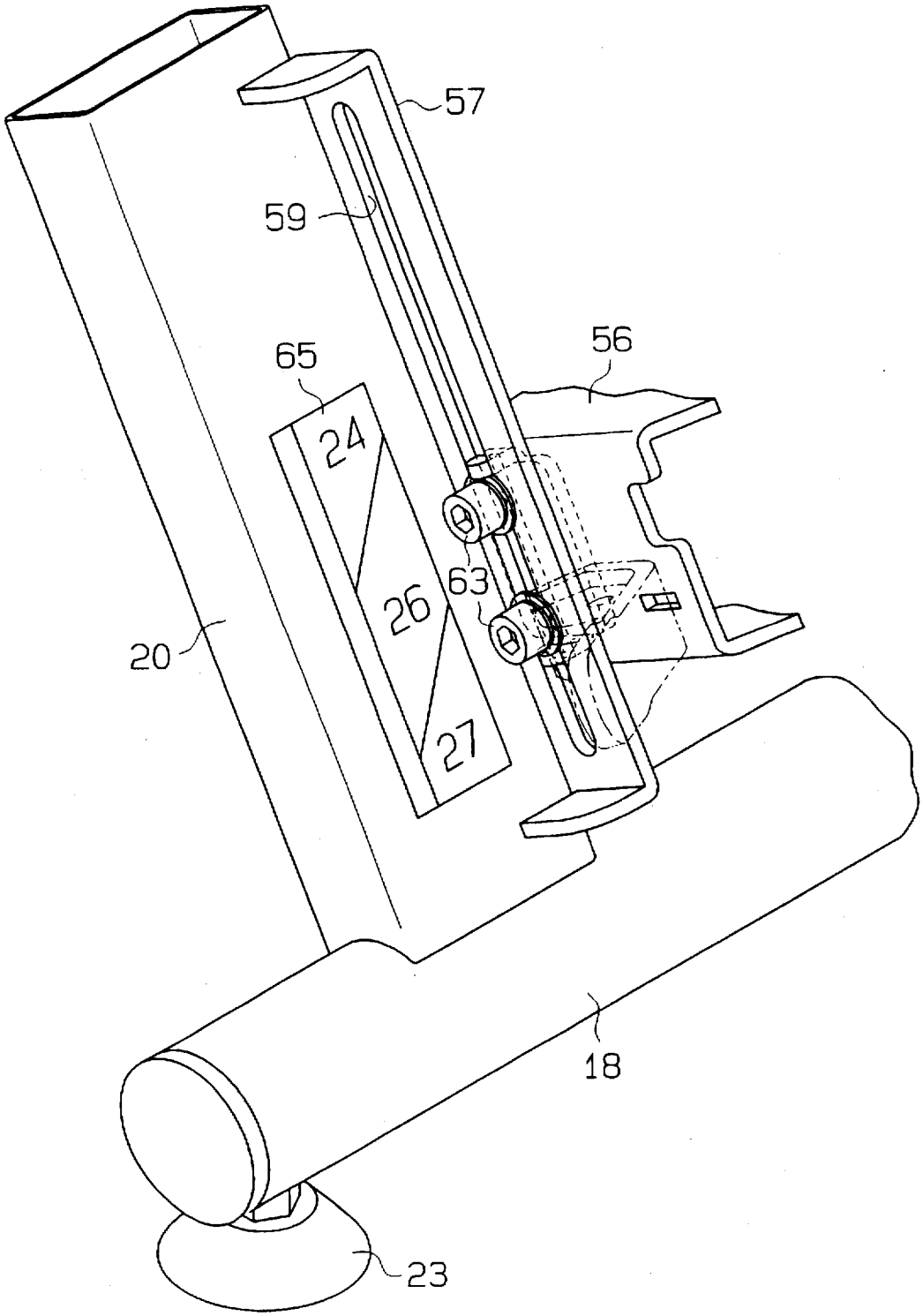
FIG. 4 is a partial perspective view showing a state where a resistance applying unit is fitted.

A pair of fitting plates 57,58 are fixed to the rear legs 20,21 at lower positions, respectively, to oppose each other. Slots 59,60 are defined in the fitting plates 57,58 to extend in the longitudinal directions of the rear legs 20,21. As shown in FIG. 4, the fixing member 56 is attached to the fitting plate 57 by a pair of bolts 63 inserted to the slot 59 such that the position of the member 56 is adjustable in the vertical direction. A scale 65 is provided on one side of the leg 20 near the zone where the fitting plate 57 is present. The numerals 24, 26 and 27 indicated on this scale 65 correspond to diameters of rear wheels. The periphery of a rear wheel of a bike should align with the number corresponding to its diameter when the bike is mounted to the exercise device. The arm 54, fixing member 56, fitting plate 57, slot 59 and bolts 63 constitute the position adjusting mechanism of this invention.

Figure 5:
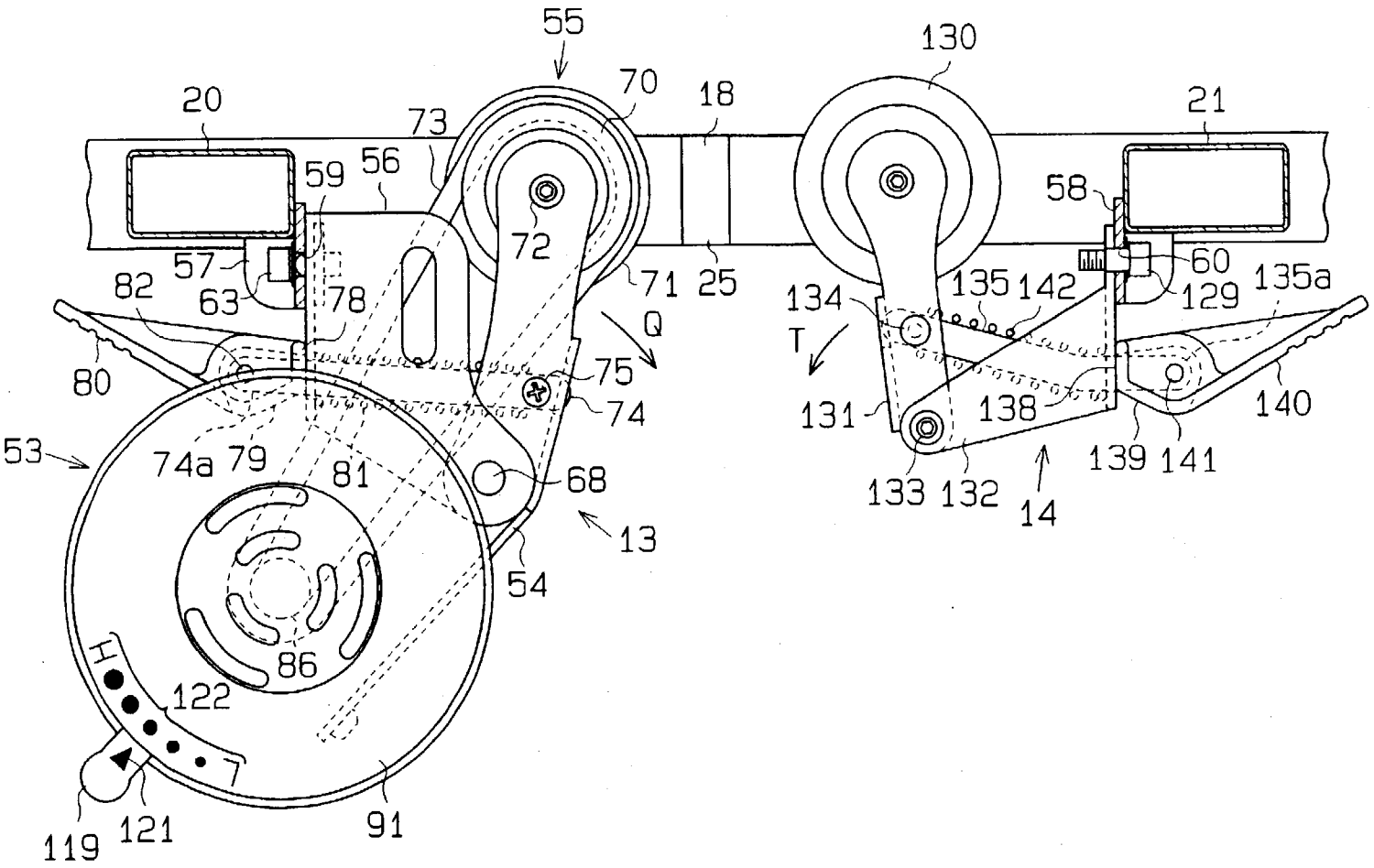
FIG. 5 is a cross-sectional view taken along the line 5—5 in FIG. 1 showing a state where a transmission wheel and an auxiliary wheel are retracted.

FIG. 5 is a cross-sectional view taken along the line 5—5 in FIG. 1. As shown in FIG. 5, the arm 54 is attached to the fixing member 56 by a shaft 68 so that the arm 54 can pivot about the shaft 68. The rotary drive wheel 55, which consists of a pulley 70 and a transmission wheel 71, is rotatably supported by a rotary shaft 72 at one end of the arm 54. The pulley 70 is fixed to the transmission wheel 71 to rotate integrally therewith. The transmission wheel 71, which is to contact the rim Rr of the bicycle B as will be described later, is made of an elastomeric material for generating a predetermined frictional resistance when brought into contact with the rim Rr. A belt 73 is wrapped around the pulley 70. The belt 73 transmits the load resistance generated by the load resistance generator 53 via the pulley 70 to the transmission wheel 71.

A connecting rod 74 is pivotally supported at one end on the arm 54 by a shaft 75 at a position spaced apart from the shaft 68 toward the rotary drive wheel 55. This connecting rod 74 has a protruding portion 74*a* extended outward (leftward in FIG. 5) through an insertion hole (not shown) formed in the fixing member 56. A control lever 80 having a first flat face 78 and an adjacent second flat face 79 is pivotally supported on the protruding portion 74*a* by a shaft 82.

A coiled compression spring 81 is fitted around the connecting rod 74 over the entire length thereof excluding the protruding portion 74*a*, and one end of the spring 81 is retained against the inner wall of the fixing member 56 and the other is retained against the shaft 75. The arm 54 is normally urged by the compression spring 81 to pivot about the shaft 68 (in the direction of the arrow Q in FIG. 5) to move the rotary drive wheel 55 away from the rear leg 20. The arm 54, fixing member 56, shafts 68,75 and compression spring 81 constitute the urging mechanism of this invention.

Figure 6:
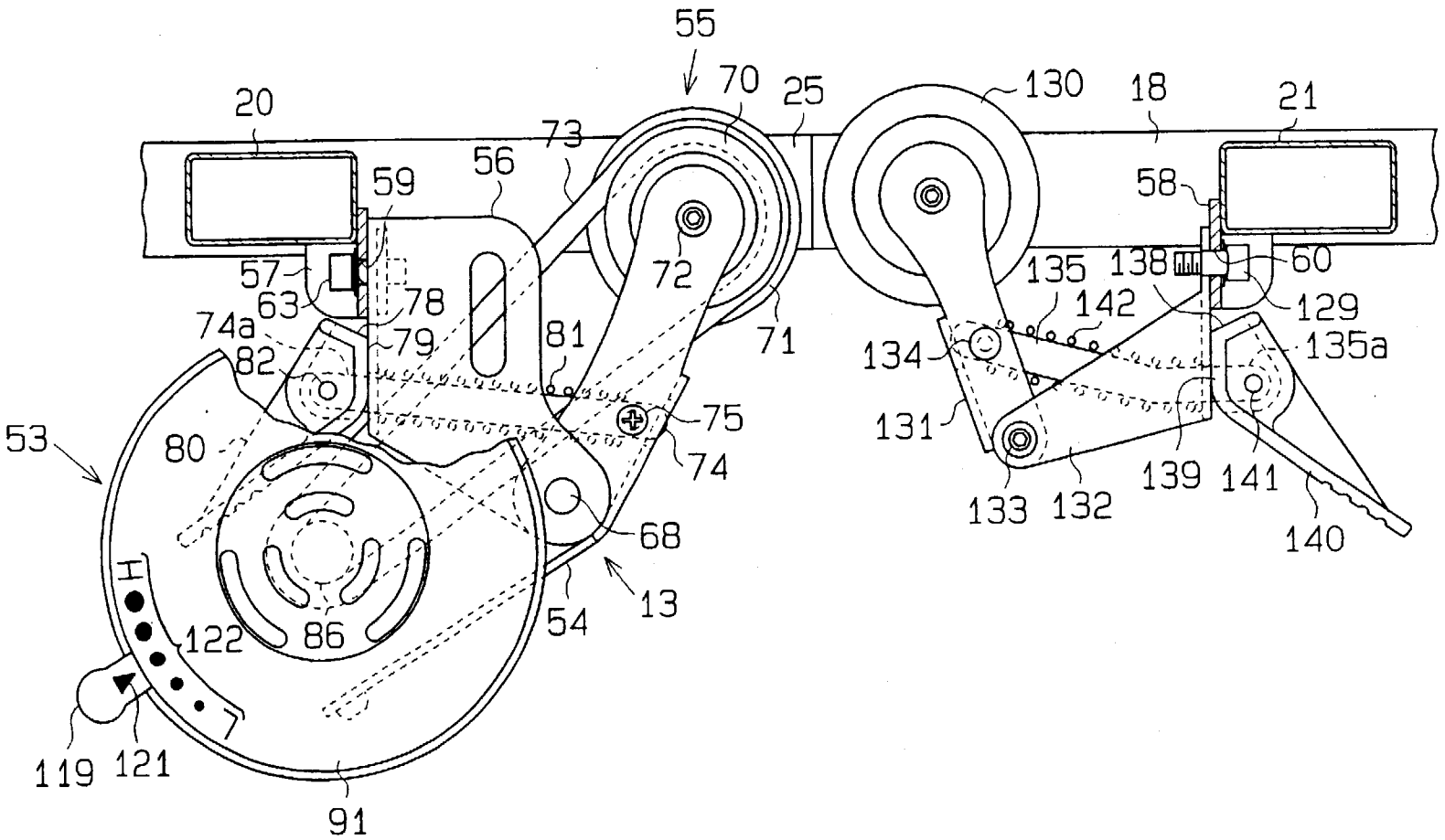
FIG. 6 is also a cross-sectional view as seen in the direction of FIG. 5 showing a state where the transmission wheel and the auxiliary wheels are located at working positions.

The control lever 80 can be switched selectively by turning the lever 80 around the shaft 82 to one of two positions: a position shown in FIG. 5 where the first flat face 78 is abutted against the fixing member 56 (hereinafter referred to as the retracted position) and a position shown in FIG. 6 where the second flat face 79 is abutted against the fixing member 56 (hereinafter referred to as the working position). The distance between the first flat face 78 and the shaft 82 is longer than the distance between the second flat face 79 and the shaft 82. Thus, the length of the protruding portion 74*a* protruding from the fixing member 56 is increased when the control lever 80 is at the retracted position, whereas it is reduced when the control lever 80 is at the working position. When the control lever 80 is switched from the retracted position to the working position, the rotary drive wheel 55 is moved away from the rear leg 20 under the urging force of the compression spring 81, as shown in FIG. 6. In this position, the compression spring 81 is extended and the length of the protruding portion 74*a* is reduced.

Meanwhile, when the control lever 80 is turned from the working position to the retracted position, the rotary drive wheel 55 is moved closer to the left-hand rear leg 20 against the urging force of the compression spring 81, as shown in FIG. 5. In this position, the compression spring 81 is compressed and the length of the protruding portion 74*a* is increased.

Next, the load resistance generator 53 will be described. A casing 85 of the generator 53 consists of an inner casing 89 having an H-shaped cross section and roughly bowl-shaped outer side casings 90 and 91 fitted to the sides of the casing 85. The inner casing 89 and the outer side casings 90 and 91 are made of resin.

A rotary shaft 86 is provided in the casing 85. The rotary shaft 86 extends across almost the entire width of the casing 85. The shaft 86 has a drive cylinder 92 contained in the casing 89. The shaft 86 is supported by a pair of bearings provided on the sides of the cylinder 92. A groove 95 is formed around the cylinder 92. The rotary shaft 86 is drive-connected to the rotary drive wheel 55 by the pulley 70 and a belt 73 hooked to the groove 95. Rotation of the rear wheel R caused by rotation of the pedals P rotates the rotary shaft 86.

A boss 97 is secured to an end of the rotary shaft 86 by means of a bolt 98 and is accommodated in the space formed between the inner casing 89 and the outer side casing 90. The boss 97 has a flange 96 formed around its periphery. A plurality of annular flywheels 87 are secured to the flange 96 by means of a plurality of bolts 99 such that the flywheels 87 rotate with the rotary shaft 86. Each flywheel 87 is made of metal to have a predetermined moment of inertia around the axis of the rotary shaft 86. Since the outer side casing 90 is removable from the inner casing 89 and the number of the flywheels 87 is adjustable, a user of this exercise device can simulate various real bicycle riding conditions by setting the appropriate number of the flywheels 87 on the rotary shaft 86.

A boss 106 is secured to the other end of the rotary shaft 86 by means of a bolt 107 and is accommodated in the space formed between the inner casing 89 and the outer side casing 91. The boss 106 has a flange 105 formed around its periphery. An annular rotary disk 88 is secured to the flange 105 by means of a plurality of bolts 108. The rotary disk 88 therefore rotates with rotary shaft 86.

An annular mounting disk 110 is placed on the inner surface of the casing 89 facing the rotary disk 88. The mounting disk 110 is secured to the casing 89 by means of bolts 111. A plurality of arcuately-shaped permanent magnets 112 are secured to the mounting disk 110.

An annular supporting disk 113 is placed inside the outer casing 91. The supporting disk 113 is rotatably supported by a plurality of supporting legs 114. A plurality of permanent magnets 115 are secured to the supporting disk 113 as in the case of the mounting disk 110.

Figure 8:
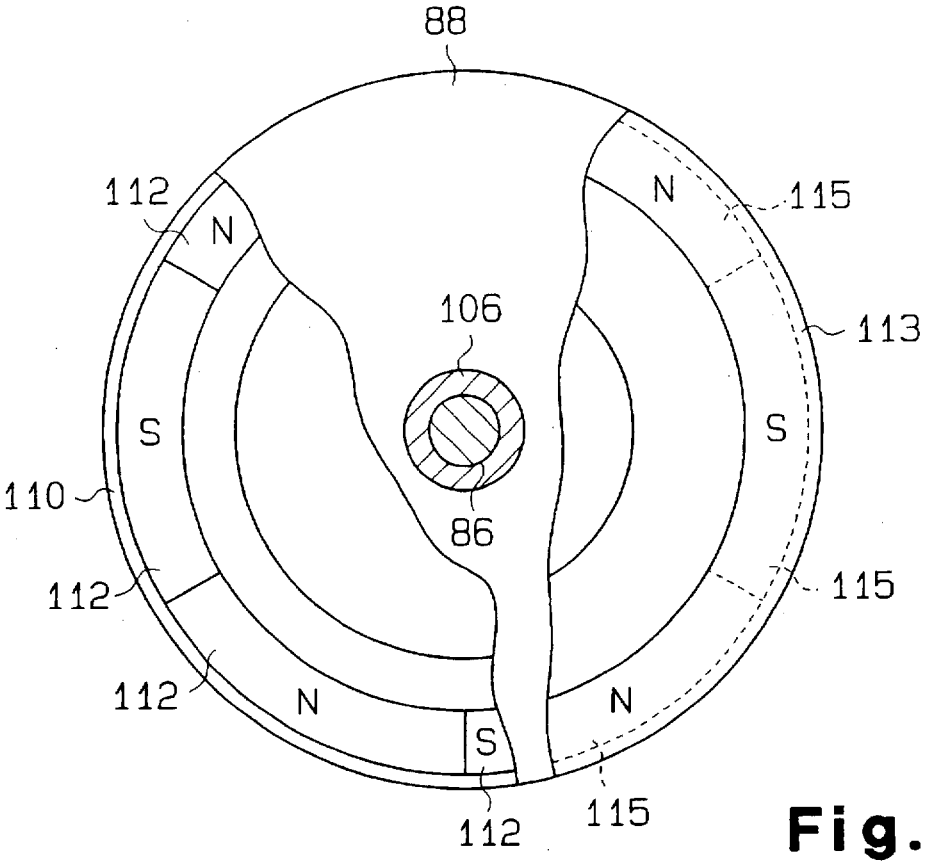
FIG. 8 is a diagrammatic side view of the resistance unit with parts broken away showing an arrangement of fixed permanent magnet pieces and of movable permanent magnet pieces.

FIG. 8 schematically shows the arrangement of the permanent magnets 112 and 115 secured on the mounting disk 110 and supporting disk 113, respectively. The fixed magnets 112 and the movable magnets 115 are arranged so as to form a circle around the shaft 86 with alternating polarities. (In the FIG. 8, the letters "N" and "S" indicate the polarity of the surface of the magnets 112 and 115, which face the rotary disk 88.) The permanent magnets 112 and 115 generate an eddy current on the rotary disk 88 as the rotary disk 88 rotates. The eddy current generates resistance on the rotary disk 88. This resistance exerts a load on the foot pedals P of the bicycle B.

Figure 7:
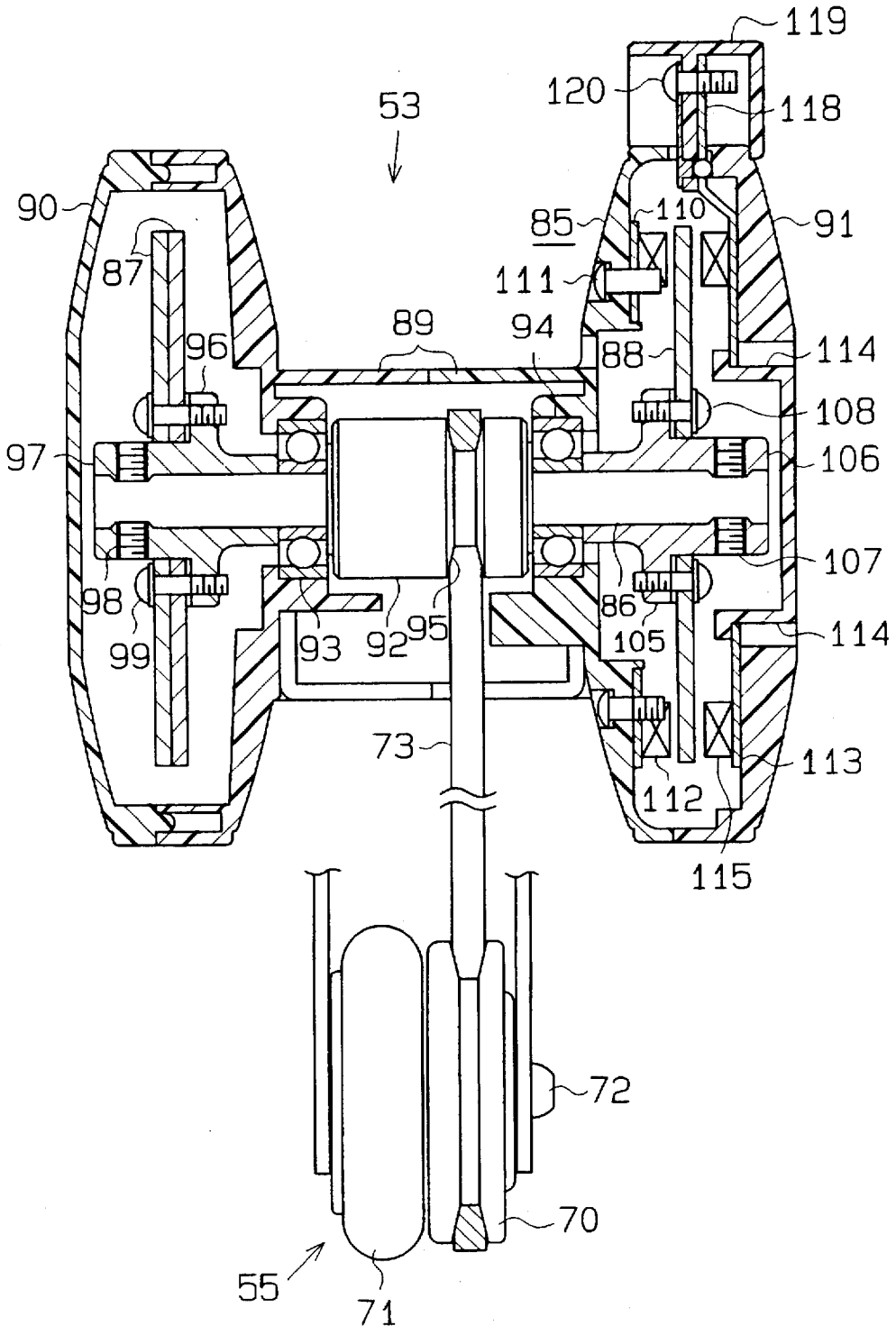
FIG. 7 is a cross-sectional view of the resistance applying unit.

As shown in FIG. 7, a protrusion 118 is formed on the periphery of the supporting disc 113. The protrusion 118 extends in the radial direction of the disk 113 and protrudes from the casing 85. An adjusting lever 119 is secured to the distal end of the protrusion 118 by means of a bolt 120. Moving the lever 119 in the circular direction around the shaft 86 alters the relative alignment of the movable permanent magnets 115 with respect to the fixed permanent magnets 112. This adjusts the amount of the eddy current generated on the rotary disk 88, which varies the magnitude of the load.

As shown in FIG. 5, an indicator 121 is printed on the lever 119, and a scale 122, which corresponds to the indicator 121, is printed on the casing 91. The indicator 121, together with the scale 122, indicates the magnitude of load applied to the pedals P.

Figure 9:
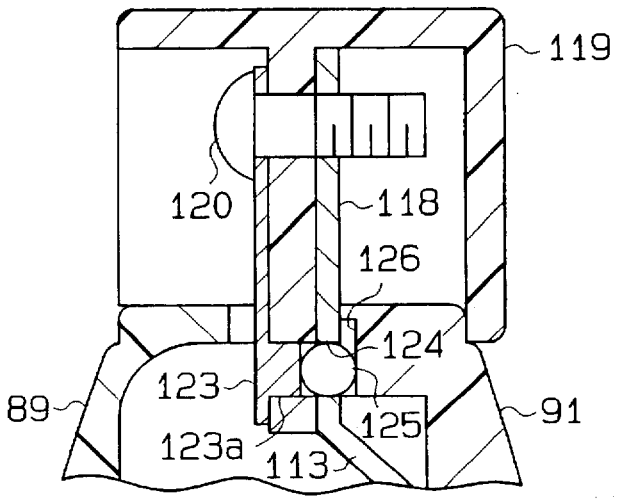
FIG. 9 is an enlarged partial cross-sectional view of a selector switch etc.

As shown in FIG. 9, a leaf spring 123 is secured to the distal end of the protrusion 118. The leaf spring 123 has a protuberance 123*a*. A hole 124 is formed in the vicinity of the proximal end of the protrusion 118. A ball 125 is placed in the hole 124. A plurality of notches 126 are formed on the inner surface of the outer casing 91. The notches 126 are arranged along the path that the hole 124 follows with a predetermined space in between one another. The protuberance 123*a* of the spring 123 contacts the ball 125 and biases it toward the notches 126. The ball 125 is thus engaged with one of the notches 126. The relative alignment of the magnets 115 with respect to the magnets 112 therefore changes in stages from a low load state indicated by "L" on the scale 122 to a high load state indicated by "H" on the scale 122.

When the indicator 121 is at the "L" position, the polarity of each magnet 115 is the same as that of the corresponding magnet 112. When the indicator 121 is at the "H" position, the polarity of each magnet 115 is opposite to that of the corresponding magnet 112. In the exercising apparatus 11 of the present invention, the load exerted on the pedals P is adjusted in stages by moving the lever 119 between the "H" and "L" position on the scale 122.

Next, the auxiliary supporting unit 14 will be described. As shown in FIG. 5, the auxiliary supporting unit 14 has an arm 131 rotatably supporting an auxiliary wheel 130 at one end thereof and a fixing member 132 for fixing the arm 131 onto the right-hand rear leg 21. A bolt 129 is inserted to the slot 60 of the fitting plate 58 provided on the right-hand rear leg 21, and the fixing member 132 is attached to the fitting plate 58 by this bolt 129 such that the position of the fixing member 132 may be adjusted in the vertical direction (in a direction normal to the plane of the paper in FIG. 5). The other end of the arm 131 is pivotally supported on the fixing member 132 by a shaft 133. The auxiliary wheel 130 of the arm 131 cooperates with the transmission wheel 71 of the rotary drive wheel 55 to form a nip to grip the rim Rr of the bicycle B therebetween and is made of an elastomeric material so as to increase frictional resistance when brought into contact with the rim Rr.

A connecting rod 135 is pivotally supported at one end on the arm 131 by a shaft 134. As shown in FIG. 5, this connecting rod 135 has a protruding portion 135*a* extended outward (rightward in FIG. 5) through an insertion hole (not shown) formed in the fixing member 132. A control lever 140 having a first flat face 138 and an adjacent second flat face 139 is pivotally supported on the protruding portion 135*a* by a shaft 141.

A coiled compression spring 142 is fitted around the connecting rod 135 over the entire length thereof excluding the protruding portion 135*a*, and one end of the spring 142 is retained against the inner wall of the fixing member 132 and other is retained against the shaft 134. The arm 131 is normally urged by the compression spring 142 to pivot about the shaft 133 (in the direction of the arrow T in FIG. 5) to move the auxiliary wheel 130 away from the right-hand rear leg 21. In this embodiment, the compression springs 81,142 provided in the resistance applying unit 13 and in the auxiliary supporting unit 14 are designed to have spring constants such that the transmission wheel 71 and the auxiliary wheel 130 exert pressure equally against the side faces of the rim Rr.

The control lever 140 is switched selectively by turning the lever 140 around the shaft 141 to one of two positions: a position shown in FIG. 5 where the first flat face 138 is abutted against the fixing member 132 (hereinafter referred to as the retracted position) and a position shown in FIG. 6 where the second flat face 139 is abutted against the fixing member 132 (hereinafter referred to as the working position).

The distance between the first flat face 138 and the shaft 141 is longer than the distance between the second flat face 139 and the shaft 141 like in the case of the control lever 80 of the resistance applying unit 13. Accordingly, the length of the protruding portion 135*a* of the connecting rod 135 protruding from the fixing member 132 is increased when the control lever 140 is at the retracted position, whereas it is reduced when the control lever 140 is at the working position. When the control lever 140 is turned from the retracted position to the working position, the auxiliary wheel 130 is moved away from the right-hand rear leg 21 under the urging force of the compression spring 142, as shown in FIG. 6. In this position, the compression spring 142 is extended and the length of the protruding portion 135*a* is reduced. As a result, the auxiliary wheel 130 and the transmission wheel 71 are positioned to oppose each other at a close distance, as shown in FIG. 6.

When the control lever 140 is turned from the working position to the retracted position, the auxiliary wheel 130 is moved closer to the right-hand rear leg 21, as shown in FIG. 5. In this instance, the compression spring 142 is compressed and the length of the protruding portion 135*a* is increased.

Next, the operation of the device will be described.

To position the bicycle B on the exercise device 11 at a predetermined position, the control levers 80,140 of the resistance applying unit 13 and of the auxiliary supporting unit 14 are first switched to their retracted positions. Thus, the transmission wheel 71 and the auxiliary wheel 130 are spaced from each other to form a clearance in which the peripheral portion of the rear wheel R is positioned.

Next, the rear wheel R is rotatably supported by the hub holding mechanism 15 and is also positioned thereby. That is, the operating handles 39,49 are operated to widen the clearance between the holders 40 and 50 to be able to receive therein the hub H of the rear wheel R. Then, the operating handles 39,49 are operated again to narrow the clearance between the holders 40 and 50 to hold the hub H between the holders 40 and 50. Further, the operating handles 39,49 are operated, with the holders 40,50 holding the hub H, to adjust the positions of the holders 40,50 in the axial direction L (see FIG. 1), and thus the position of the rear wheel R is adjusted to be in alignment with the position of the tape 25.

According to this embodiment, the positions of the operating cylinders 32,33 are adjusted in the axial direction L by operating the operating handles 39,49, and thus the rear wheel R is aligned with the tape 25.

By operating the operating handles 39,49 as described above, the rear wheel R of the bicycle B can be rotatably supported by the exercise device 11 and is also placed at a predetermined position with respect to the device 11. Next, the position of the resistance applying unit 13 and that of the auxiliary supporting unit 14 are adjusted in the radial direction of the rear wheel R. First, the bolt 63 is loosened to make the fixing member 56 of the resistance applying unit 13 movable relative to the fitting plate 57. After the position of the resistance applying unit 13 is adjusted such that the transmission wheel 71 is located beside the rim Rr of the rear wheel Rr, the bolt 63 is fastened again to fix the unit 13 in position.

Likewise, the bolt 129 is loosened in the auxiliary supporting unit 14 to make the fixing member 132 movable relative to the fitting plate 58. After the position of the auxiliary supporting unit 14 is adjusted such that the auxiliary wheel 130 is located beside the rim Rr, the bolt 129 is fastened again to fix the unit 14 in position.

Thus, the transmission wheel 71 of the resistance applying unit 13 and the auxiliary wheel 130 of the auxiliary supporting unit 14 are fixed at positions corresponding to the diameter of the rim Rr. Next, the control levers 80,140 of the resistance applying unit 13 and of the auxiliary supporting unit 14 are operated to switch the units 13,14 from the retracted positions to the working positions. Consequently, the arm 54 of the resistance applying unit 13 is pivoted around the shaft 68 under the urging force of the compression spring 81 to move the transmission wheel 71 closer to the auxiliary wheel 130. Likewise, the arm 131 of the auxiliary supporting unit 14 is pivoted around the shaft 133 under the urging force of the compression spring 142 to move the auxiliary wheel 130 closer to the transmission wheel 71.

Figure 10:
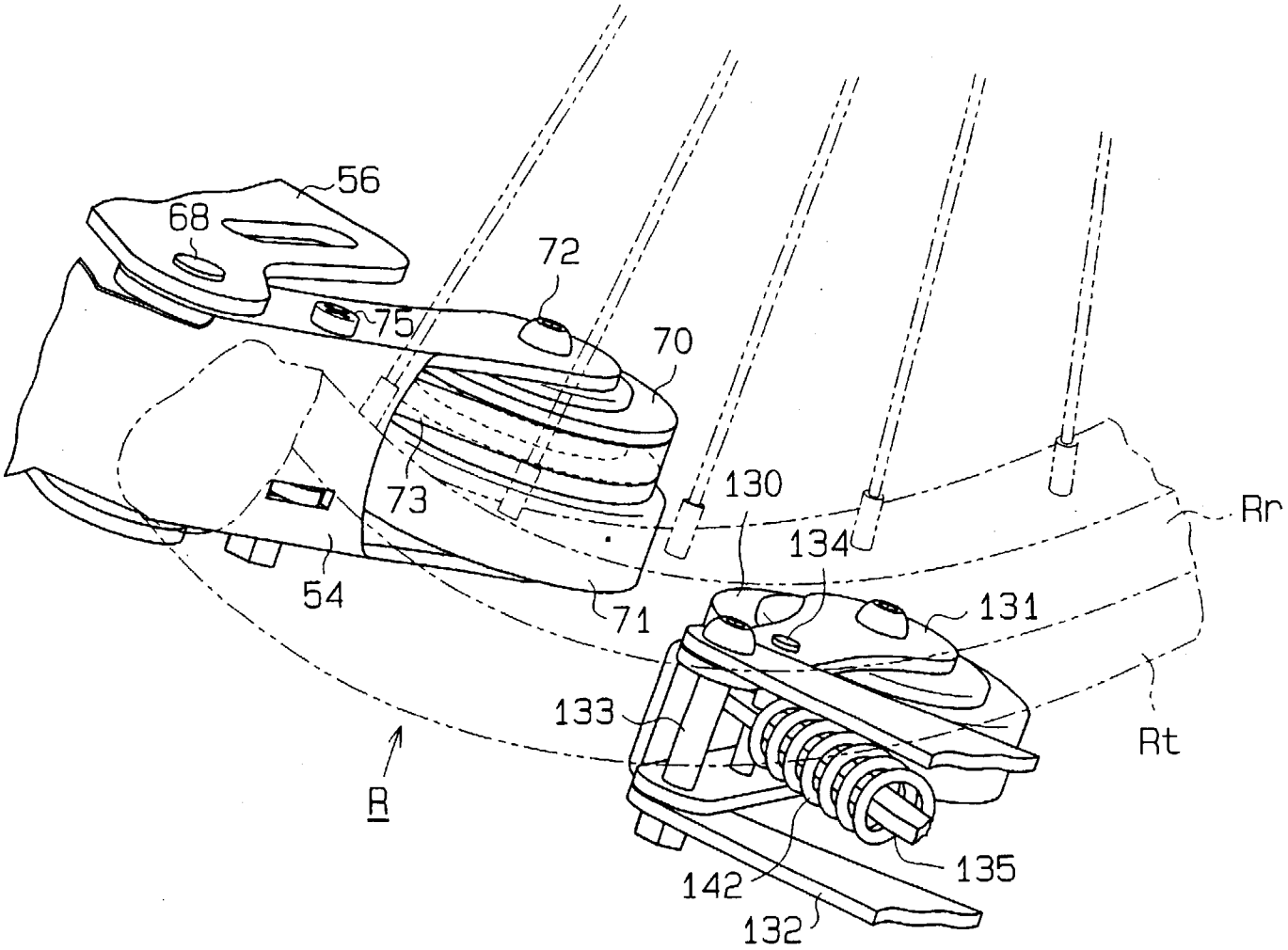
FIG. 10 is a perspective view showing a state where the transmission wheel and the auxiliary wheels are brought into contact with side faces of a rim.

As a result, the clearance between the transmission wheel 71 and the auxiliary wheel 130 is narrowed, and the wheels 71,130 are brought into contact with the side faces of the rim Rr, as shown in FIG. 10. In this instance, the transmission wheel 71 and the auxiliary wheel 130 are brought into contact with the side faces of the rim Rr with forces corresponding to the urging forces of the compression springs 81,142. Accordingly, a predetermined frictional resistance is generated between each side face of the rim Rr and the transmission wheel 71 or the auxiliary wheel 130. Thus, when the rear wheel R is rotated, the transmission wheel 71 and the auxiliary wheel 130 are steadily rotated with the rotation of the wheel R.

The preparation for using the exercise device with a bicycle is completed by performing the above operations.

When the pedals P of the bicycle B are rotated, the driving force is transmitted to the rear wheel R via the chain C. The transmission wheel 71 and the supporting wheel 130 are rotated by the rotation of the rear wheel R. The driving force of the transmission wheel 71 is transmitted to the rotary shaft 86 of the resistance generator 53. The rotary disk 88 rotates in accordance with the rotation of the shaft 86.

At this time, eddy current is generated by the magnetic flux of the magnets 112 and 115 on the rotary disk 88. The eddy current generates rotary force against the rotation of the shaft 86. The rotary force is transmitted as resistive load to the pedals P via the transmission wheel 71 and the rear wheel R.

Figure 11:
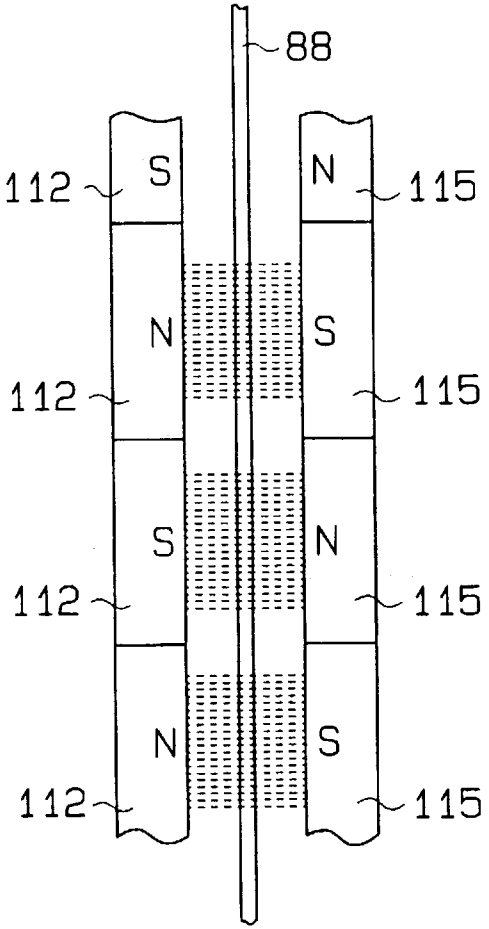
FIGS. 11(*a*)–11(*c*) are explanatory drawings showing magnetic flux penetrating a rotary disc.
Figure 11:
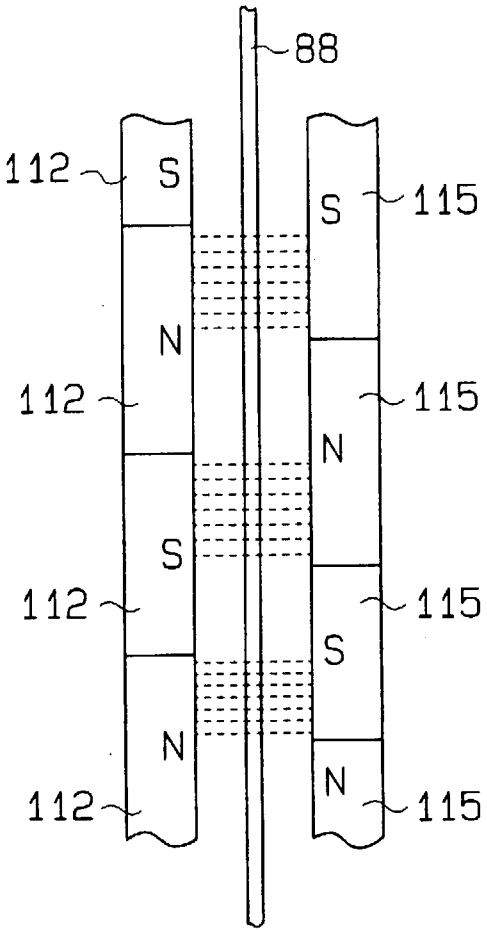
Figure 11:
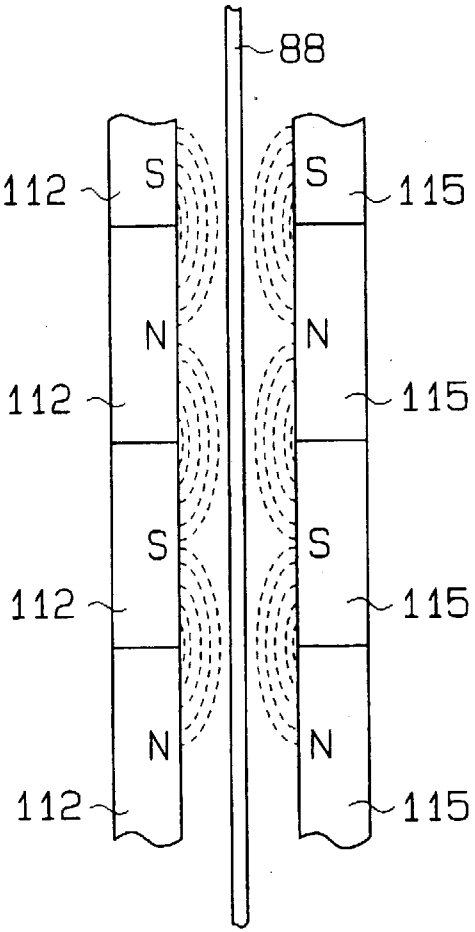
Figure 12:
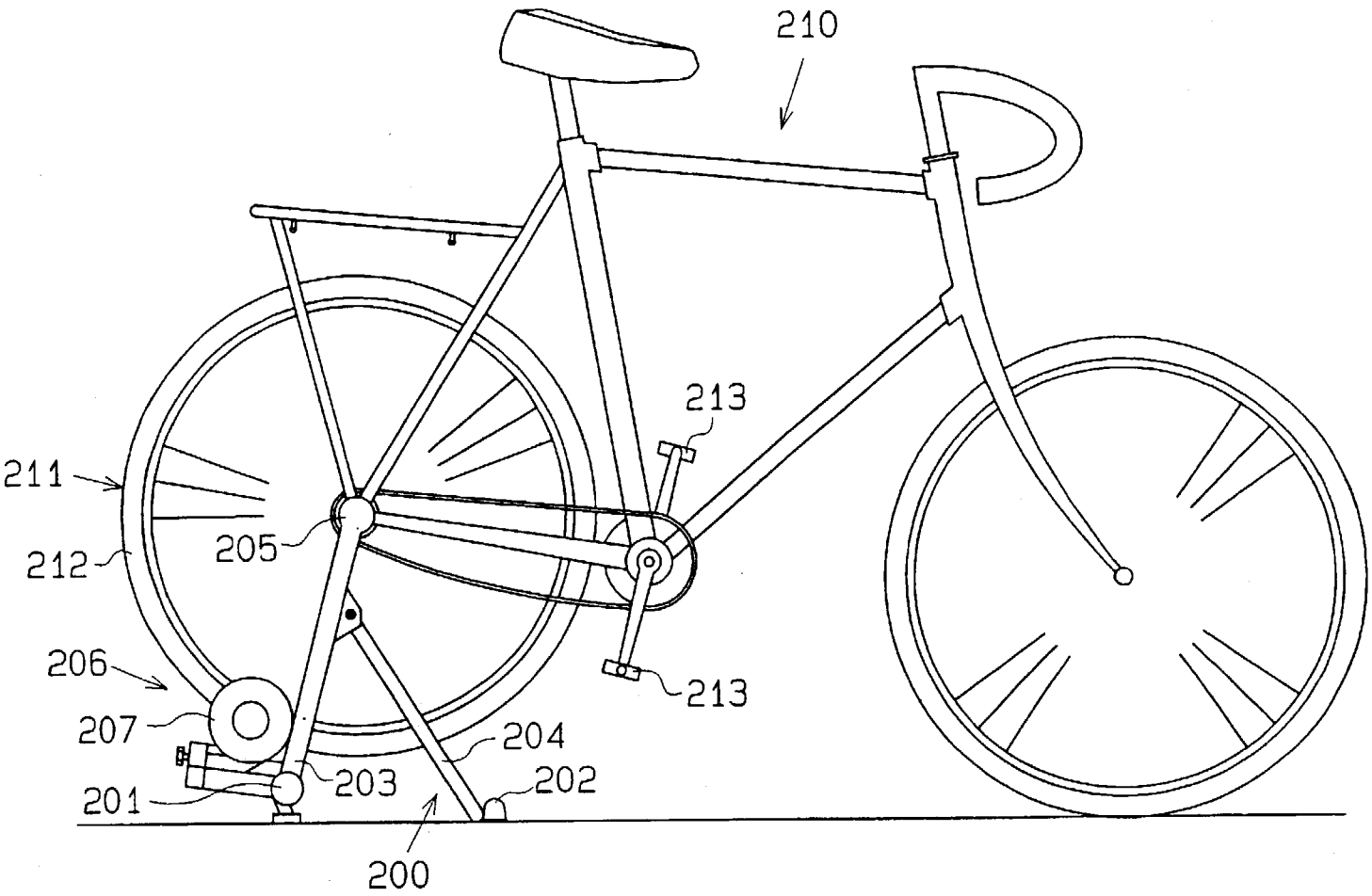
Fig.12(Prior Art)
FIG. 12 is a side view showing a prior art bicycle exercise device.
Figure 13:
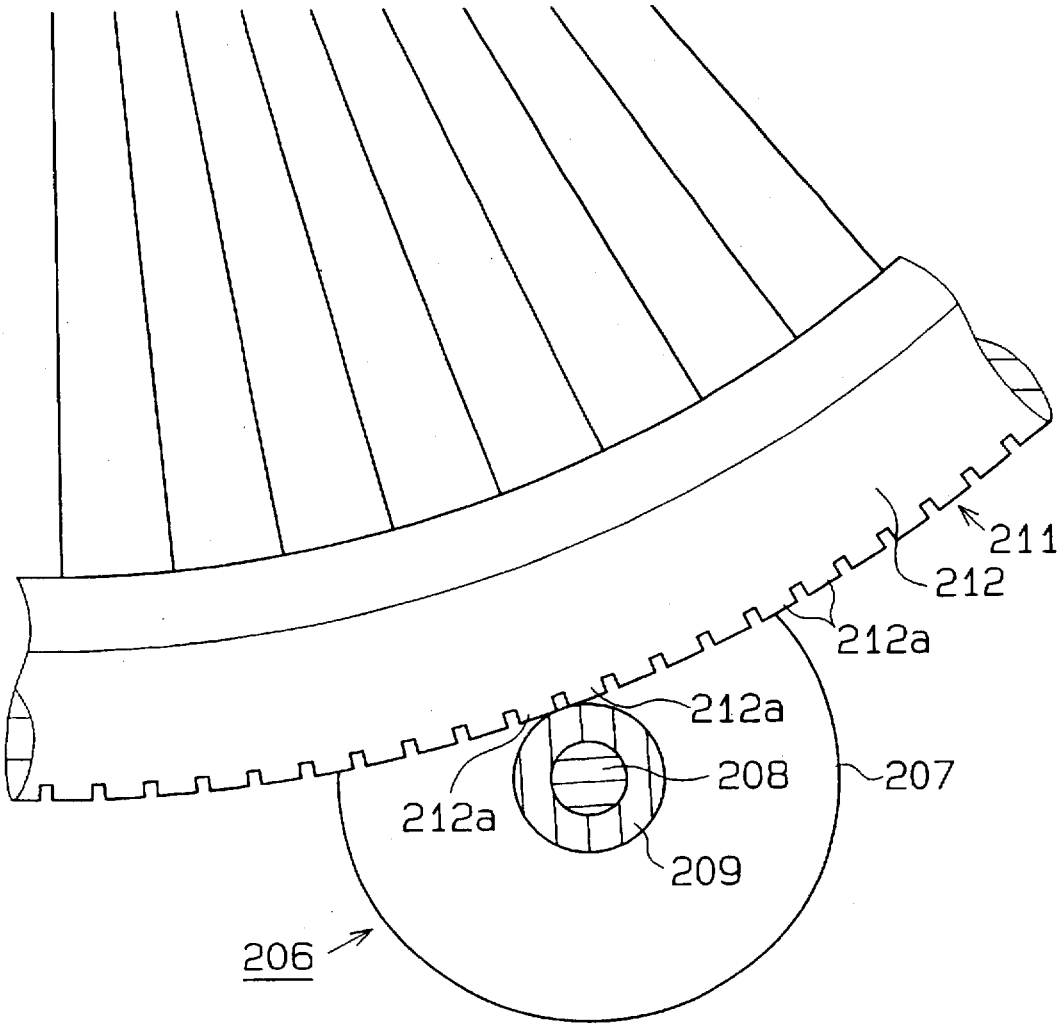
Fig.13(Prior Art)
FIG. 13 is a cross-sectional view showing the relationship between a drive cylinder in a prior art resistance applying unit and a rear wheel of a bicycle.

When the indicator 121 is at "L" on the scale 122, the polarity of each magnet 115 is the same as that of the corresponding magnet 112 as shown in FIG. 11(*a*). The magnetic flux passing through the rotary disk 88 is close to zero. (The magnetic flux is illustrated with short dashed lines in FIG. 11.) Since the magnitude of the generated eddy current depends on the magnitude of the magnetic flux passing the disk 88 and the rotational speed of the disk 88, magnetic flux close to zero generates almost no eddy current and therefore generates almost no resistive load.

On the other hand, for example, when the indicator 121 is at "H" on the scale 122, the polarity of each magnet 115 is opposite to that of the corresponding magnet 112 as shown in FIG. 11(*c*). The magnetic flux passing through the rotary disk 88 is increased. The resistive load is increased accordingly.

The relative alignment of the magnets 115 with respect to the magnets 112 may be continuously varied between the position shown in FIG. 11(*a*), in which the polarities of the facing magnets are the same, and the position shown in FIG. 11(*c*), in which the polarities of the facing magnets are opposite, via the middle position shown in FIG. 11(*b*), which is the midpoint between the "L" and "H" on the scale 122. The magnitude of the magnetic flux can be changed by selecting the position of the indicator 121 on the scale 122. A user can thus obtain a desired resistive load applied to the pedals.

As described above, both of the transmission wheel 71 of the resistance applying unit 13 and the supporting wheel 130 of the auxiliary supporting unit 14 contact the side wall of the rim Rr. That is, the tread pattern of the rear tire does not contact the transmission wheel 71 and the supporting wheel 130. Therefore, using the apparatus for a bicycle with rugged tires, designed for cross-country riding, produces little noise.

Further, as described above, the position of the resistance applying unit 13 and auxiliary supporting unit 14 may be adjusted in the radial direction of the rear tire R. The exercising apparatus 11 according to this embodiment is therefore adaptable to bicycles with different rear wheel diameters. In other words, the apparatus 11 is adaptable to a child-size bicycle with a small diameter rear wheel as well as for an adult-size bicycle with a large diameter rear wheel.

In addition, when the resistance applying unit 13 is to be positioned, its vertical position can be easily determined by referring to the scale indicia 65 provided on the left-hand rear leg 20, and thus the set-up time is reduced. In the procedure of positioning the resistance applying unit 13 described above, the bicycle B is first supported by the framework 12, and then the position of the resistance applying unit 13 is adjusted. However, since the position of the resistance applying unit 13 can be easily determined, the resistance applying unit 13 may be first fixed at the position corresponding to the diameter of the rim Rr of the bicycle B referring to the scale 65, and then the bicycle B may be supported by the framework 12.

Further, the transmission wheel 71 and the auxiliary wheel 130 are brought into contact with the side faces of the rim Rr with pressures corresponding to the urging forces of the compression springs 81,142. Thus, the rear wheel R is steadily supported by the wheels 71,130. Furthermore, since the transmission wheel 71 and the auxiliary wheel 130 are positioned to oppose each other, the lines of action of the pressures applied by the wheels 71, 130 to each side face of the rim Rr coincide with each other. Accordingly, deformation of the rim Rr is avoided.

In other words, if the auxiliary wheel 130 is omitted such that only the pressure of the transmission wheel 71 is applied to one side face of the rim Rr, the rim Rr is liable to be deformed slightly by the pressure. If the auxiliary wheel 130 and the transmission wheel 71 are not arranged to oppose each other, two forces acting along different lines of action will be applied to the rim Rr, and the rim Rr will be subjected to a bending force and is likely to deform.

However, such bending force is avoided in the present invention to avoid deformation of the rim Rr. Accordingly, deflection of the rear wheel R during rotation is controlled to enable a rider to perform stable loaded exercise.

Further, since a predetermined frictional resistance is achieved by the pressure between the transmission wheel 71 and the side face of the rim Rr, the load resistance can be steadily transmitted from the transmission wheel 71 to the rear wheel R. Particularly, since a rubbery material is selected as the material for forming the transmission wheel 71 and the auxiliary wheel 130, the side faces of the rim Rr, which are usually made of a metallic material and have a smooth surface with substantially no roughness, make intimate, highly frictional contact with the transmission wheel 71 and the auxiliary wheel 130 due to their resilience. Accordingly, even if the load resistance generated by the load resistance generator 53 is increased, the thus increased load resistance is steadily transmitted to the rear wheel R.

Further, the arms 54,131 of the resistance applying unit 13 and of the auxiliary supporting unit 14 are rotatable around the shafts 68,133 such that the transmission wheel 71 and the auxiliary wheel 130 are movable toward or away from the side faces of the rim Rr. Accordingly, if the pressure between the side face of the rim Rr and the transmission wheel 71 or the auxiliary wheel 130 is excessively increased by an unbalanced rear wheel R, for example, the transmission wheel 71 or the auxiliary wheel 130 can move away from the side face of the rim Rr against the urging force of the compression spring 81 or 142. As a result, problems such as deformation or damage caused by the excessive force applied by the transmission wheel 71 or the auxiliary wheel 130 are avoided.

In addition, the position of the rear wheel R can be easily adjusted in the axial direction L by operating the handles 39,49 such that it is aligned with the tape 25 after the hub H of the bicycle B is held by the holders 40,50 of the hub holding mechanism 15. Since the rear wheel R can be located easily at a predetermined position, improper positioning of the rear wheel R, as described above, and unbalanced pressure applied by the transmission wheel 71 and the auxiliary wheel 130 are prevented. Consequently, the load resistance generated by the load resistance generator 53 is steadily transmitted to the rear wheel R.

Further, by operating the control levers 80,140 of the resistance applying unit 13 and of the auxiliary supporting unit 14, the clearance between the transmission wheel 71 and of the auxiliary wheel 130 can be selectively switched to a width where it can receive the peripheral portion of the rear wheel R and to a width where the wheels 71,130 are brought into contact with the side faces of the rim Rr. Accordingly, when the hub H is being fixed by the hub holding mechanism 15, the transmission wheel 71 and the auxiliary wheel 130 do not interfere, and thus the rear wheel R can be easily positioned between these wheels 71 and 130. Then, by shifting the control levers 80,140 to the working positions, the transmission wheel 71 and the auxiliary wheel 130 are brought into contact with the side faces of the rim Rr. As described above, the exercise device 11 is easily handled, and thus the set-up procedures can be completed in a very short time.

This invention is not limited to the constitution of the preferred embodiment described above, but can be embodied in various other ways, some of which are described below:

(1) While the foregoing describes a load resistance generator 53 that is designed to generate load resistance under the action of eddy current induced on the surface of the rotary disc 88, a load resistance generator utilizing a fan that increases or reduces air resistance depending on the revolution of the rotary disk 88 or a load resistance generator that generates load resistance by the frictional resistance caused by bringing a contact member into contact with the rotary disc 88 may be employed;

(2) While the rear wheel R is more securely supported by locating the auxiliary supporting unit 14 so as to avoid rotational deflection of the wheel R in the foregoing embodiment, the auxiliary supporting unit 14 may be omitted so as to reduce in the cost of the exercise device 11;

(3) While the transmission wheel 71 and the auxiliary wheel 130 contact the rim Rr at the side faces thereof in the foregoing disclosure, these wheels 71 and 130 may be brought into contact with the side walls of the rim Rr and with the side faces of the tire Rt (shown in FIG. 10) having no tread pattern formed thereon; and (4) While a rubbery material is used as the material for forming the transmission wheel 71 and the auxiliary wheel 130 in the foregoing embodiment, a synthetic resin material having similar properties to the rubbery material, including abrasion resistance and elasticity may be used instead.

Therefore, the present examples and embodiment are to be considered as illustrative and not restrictive and the invention is not to be limited to the details given herein, but may be modified within the scope of the appended claims.

What is claimed is:

1. A bicycle exercise device for use with a bicycle having a rotatable rear wheel that includes a rim for supporting a tire, wherein the device comprises:

a framework for supporting the rear wheel in an elevated position;

a rotary drive member constructed and supported to be driven by the rear wheel;

a resistance applying unit for applying a resistance load to the rear wheel with the rotary drive member, wherein the rotary drive member is constructed and arranged to engage the rim;

a mechanism for supporting the rotary drive member, wherein the supporting mechanism is adjustable such that it can be moved between various positions in a radial direction with respect to the wheel to accommodate various wheel diameters; and indicia for indicating the various wheel sizes that correspond to the various positions of the supporting mechanism.

2. A bicycle exercise device according to claim 1, wherein the rotary drive member is supported in a manner such that it is movable toward and away from the rim.

3. A bicycle exercise device according to claim 1, wherein the rotary drive member is biased toward the rim.

4. A bicycle exercise device according to claim 1 including a wheel holding mechanism that is constructed to be axially variable to permit the rear wheel to be adjustably moved in an axial direction with respect to the framework.

5. A bicycle exercise device according to claim 1 including an auxiliary rotary member for engaging a side of the rim opposite to that engaged by the rotary drive member.

6. A bicycle exercise device according to claim 5, wherein said rotary drive member and said auxiliary rotary member form a nip for gripping said rim.

7. A bicycle exercise device according to claim 1, wherein said rotary drive member includes elastomeric material for enhancing friction between the rotary drive member and the rim when the rotary drive member is engaged with the rim.

8. A bicycle exercise device according to claim 1, wherein the tire includes a treaded surface, and wherein the rotary drive member is constructed and arranged to contact parts of the wheel other than said treaded surface to avoid noise generated by the treaded surface.

9. A bicycle exercise device according to claim 1, wherein said rotary drive member includes elastomeric material for enhancing friction between the rotary drive member and the wheel when the rotary drive member is engaged with the wheel.

10. A bicycle exercise device for use with a bicycle having a rotatable rear wheel that includes a rim for supporting a treaded tire, wherein the device comprises:

a framework for supporting the rear wheel in an elevated position;

a rotary drive member constructed to be driven by the rear wheel;

an auxiliary rotary member supported by the framework to form a nip with the rotary drive member, wherein the nip is adapted to grip the wheel such that it avoids contact with the treads of the tire;

a resistance applying unit for applying a resistance load to the rear wheel with the rotary drive member;

said nip being adjustably supported by the framework such that it is movable between various positions in a radial direction with respect to the wheel to accommodate various wheel diameters; and indicia for indicating the various wheel sizes that correspond to the various positions of the nip.

11. The exercise device according to claim 10, wherein the nip is constructed and arranged to grip the rim.

12. A bicycle exercise device according to claim 10, wherein the rotary drive member is supported in a manner such that it is movable toward and away from the wheel, and the auxiliary rotary member is supported in a manner such that it is movable toward and away from the wheel.

13. A bicycle exercise device according to claim 10, wherein the rotary drive member and the auxiliary rotary member are biased toward the wheel.

14. A bicycle exercise device according to claim 10 including a wheel holding mechanism that is constructed to be axially movable to permit the rear wheel to be adjustably moved in an axial direction with respect to the framework.

* * * * *